US009614301B2

(12) United States Patent
Ludewig et al.

(10) Patent No.: US 9,614,301 B2
(45) Date of Patent: Apr. 4, 2017

(54) SPRING FORCE CONNECTION TERMINAL AND PLUG CONNECTOR

(71) Applicant: WAGO Verwaltungsgesellschaft mbH, Minden (DE)

(72) Inventors: Carsten Ludewig, Lauenhagen (DE); Viktor Mickmann, Bielefeld (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 15/031,235

(22) PCT Filed: Oct. 17, 2014

(86) PCT No.: PCT/EP2014/072342

§ 371 (c)(1),
(2) Date: Apr. 21, 2016

(87) PCT Pub. No.: WO2015/059054

PCT Pub. Date: Apr. 30, 2015

(65) Prior Publication Data

US 2016/0248174 A1 Aug. 25, 2016

(30) Foreign Application Priority Data

Oct. 21, 2013 (DE) ..... 10 2013 111 574

(51) Int. Cl.
*H01R 4/48* (2006.01)
*H01R 9/24* (2006.01)

(52) U.S. Cl.
CPC ..... *H01R 4/4836* (2013.01); *H01R 4/4827* (2013.01); *H01R 9/2408* (2013.01)

(58) Field of Classification Search
CPC .. H01R 4/4836; H01R 13/113; H01R 4/4827; H01R 9/2408; H01R 13/193; H01R 4/4818; H01R 9/2666
(Continued)

(56) References Cited

U.S. PATENT DOCUMENTS 6,074,241 A * 6/2000 Patel ..... H01R 4/4827 439/1
6,682,364 B2 * 1/2004 Cisey ..... H01R 9/2666 439/441
(Continued)

FOREIGN PATENT DOCUMENTS

DE 4336956 A1 5/1995
DE 10037191 C2 3/2003
(Continued)

OTHER PUBLICATIONS

International Search Report for corresponding patent application No. PCT/EP2014/072342 dated Jan. 5, 2015.
(Continued)

*Primary Examiner* — Jean F Duverne
(74) *Attorney, Agent, or Firm* — Renner, Otto, Boisselle and Sklar LLP

(57) ABSTRACT

The invention describes a spring-three terminal connection (1) for the terminal connection of electrical conductors, having an insulating-material housing (2) which has at least one conductor insertion opening (12) for the insertion of an electrical conductor, at least one clamping spring (5) which has a contact limb (7), a clamping limb (10) and a spring bow (8) which connects the contact limb (7) and the clamping limb (10) to one another, and having at least one operating button (15) which is accommodated in the insulating-material housing such that it can be displaced and which has an operating area (14) for making contact with the clamping limb (10) and moving the clamping limb (10) in the direction of the contact limb (7) for opening the clamping point when the operating button (15) is displaced in the direction of the interior of the insulating-material housing (2). The insulating-material housing (2) contains at least one button opening (16) for accommodating an associated operating button (15), said button opening being open in the
(Continued)

direction of an associated conductor insertion opening (12). The operating button (15), which is mounted in this button opening (16) such that it can be displaced, forms part of the wall arrangement of the conductor insertion opening (12). Starting from a mouth section (50) which adjoins the conductor insertion opening (12), the button opening (16) is widened in the direction of the hack (51) of the button opening (16), said back being situated opposite the conductor insertion opening (12). The cross section of the operating button (15) is matched to the widening contour of the button opening (16).

11 Claims, 9 Drawing Sheets

(58) Field of Classification Search
USPC ..... 439/729
See application file for complete search history.

(56) References Cited

U.S. PATENT DOCUMENTS

| | | | | |
|---|---|---|---|---|
| 6,851,967 | B2 * | 2/2005 | Miyoshi | H01R 4/4836 439/441 |
| 7,004,781 | B2 | 2/2006 | Walter | |
| 7,244,140 | B2 * | 7/2007 | Edenharter | H01R 4/4818 439/439 |
| 7,249,963 | B2 * | 7/2007 | Ramm | H01R 13/193 439/437 |
| 7,287,999 | B2 | 10/2007 | Holterhoff et al. | |
| 7,762,834 | B2 * | 7/2010 | Schrader | H01R 4/4836 439/441 |
| 8,062,079 | B2 * | 11/2011 | Hoppmann | H01R 4/4836 439/834 |
| 8,083,556 | B2 * | 12/2011 | Stadler | H01R 4/4818 439/834 |
| 8,579,651 | B2 * | 11/2013 | Hanning | H01R 4/4836 439/441 |
| 8,882,533 | B2 * | 11/2014 | Brandberg | H01R 13/193 439/441 |
| 9,093,762 | B2 | 7/2015 | Schwarzkopf et al. | |
| 2012/0295495 | A1 | 11/2012 | Wu | |

FOREIGN PATENT DOCUMENTS

| | | | |
|---|---|---|---|
| DE | 20308863 | U1 | 8/2003 |
| DE | 202006009460 | U1 | 3/2007 |
| DE | 102008062137 | A1 | 6/2010 |
| DE | 202011000748 | U1 | 7/2012 |
| DE | 102013104394 | A1 | 10/2014 |
| EP | 0899818 | B1 | 11/2002 |
| JP | 2001307789 | A | 11/2001 |

OTHER PUBLICATIONS

International Preliminary Report on Patentability for corresponding patent application No. PCT/EP2014/072342 dated Apr. 26, 2016.

* cited by examiner a) b) c)

SPRING FORCE CONNECTION TERMINAL AND PLUG CONNECTOR

This application is a national phase of International Application No. PCT/EP2014/072342 filed Oct. 17, 2014.

The invention relates to a spring-force terminal connection for clamping electrical conductors having:

an insulating-material housing that comprises at least one conductor inserting opening for inserting an electrical conductor, at least one clamping spring that comprises a contact limb, a clamping limb and a spring bow that connects the contact limb and the clamping limb to one another, and having at least one actuating lever that is received in a displaceable manner in the insulating-material housing and comprises an actuating surface for contacting the clamping limb and for displacing the clamping limb in the direction towards the contact limb so as to open the clamping site as the actuating lever is displaced in the direction towards the inner space of the insulating-material housing.

Spring-force terminal connections of this type are used to clamp electrical conductors and are advantageous in particular if a plurality of such spring-force terminal connections are installed close to one another in a plug connector.

DE 43 36 965 A1 illustrates a connection terminal having a two-limb clamping spring that pushes and clamps in each case against a current. rail in an electrically conductive manner an electrical conductor that is to be connected. An actuating lever is provided for simultaneously actuating the clamping limbs that lie opposite one another so as to open the respective clamping sites. The actuating lever comprises a half-round, recess-shaped surface that faces the respective conductor inserting duct and forms a part wall of the respective conductor inserting duct.

DE 100 37 191 C2 discloses a clamp having an insulating-material housing, wherein an actuating lever for a clamping spring comprises a recess-shaped guiding surface for an electrical conductor that is to be inserted.

EP 0 899 818 B1 discloses a connection terminal having a box spring that is arranged in a terminal housing and comprises a clamping limb for clamping an electrical conductor. An actuating part that can be displaced in the longitudinal direction of the clamping limb towards its clamping end is provided and said actuating part comprises a through-going duct for introducing an electrical conductor. The through-going duct. extends from a conductor inserting opening at the lever end as far as a conductor outlet opening at the inner end of the actuating part. The through-going duct and the conductor inserting opening of the actuating part are open at one side along a longitudinal side and are closed at the open side by the terminal housing.

It follows from this that the object of the present invention is to provide an improved spring-force terminal connection, wherein an actuating lever is received in a very compact and stable manner in the insulating-material housing.

The object is achieved by means of the spring-force terminal connection having the features of claim 1. Advantageous embodiments are described in the subordinate claims.

Furthermore, the object is achieved by means of the plug connector having an insulating-material housing and having at least one such spring-force terminal connection.

It is proposed that at least one lever opening in the insulating-material housing is provided for receiving an allocated actuating lever, wherein this lever opening is open in each case towards an allocated conductor inserting opening. The actuating lever that is mounted in a displaceable manner in this lever opening forms part of the wall of the conductor inserting opening. This is possible by virtue of the fact that the lever opening is open towards the conductor inserting opening and this open part of the lever opening is at least in part filled by the actuating lever. The lever opening becomes wider starting from an outlet section, which is adjacent to the conductor inserting opening, and leading to the back of the lever opening that is opposite the conductor inserting opening. The cross section of the actuating lever is tailored to suit the widening contour of the lever opening. As a result, the actuating lever is narrower in width in the region adjacent to the electrical conductor, in other words in the part that forms the wall of the conductor inserting opening, than in the opposite region that is adjacent to the clamping spring. In this manner, the actuating lever is mounted in a stable manner in the insulating-material housing while the force flow is improved and the construction is compact.

It is particularly advantageous if the actuating lever comprises, on the actuating surface that lies opposite the surface that forms a part of the wall of the insulating-material housing, a depression for receiving a section of the clamping limb. The clamping limb is consequently inserted into this depression, which results in an improved mounting of the actuating lever whilst reducing the force loading that acts on the adjacent insulating-material housing and improves the guiding arrangement on the clamping limb of the clamping spring.

It is particularly advantageous if the actuating lever tapers from its head end, which is accessible from the outer side so as to displace the actuating lever, as far as the actuating surface that lies against the clamping limb in the inner space of the insulating-material housing. Consequently, sufficient surface is provided on the head end so as to push down the actuating lever whilst reducing the amount of installation space required. The actuating lever is tapered in a manner that is optimized to suit the available space above the clamping limb that extends in an inclined manner with respect to the actuating direction and the conductor inserting direction and this ensures optimum actuating kinematics in the case of a minimum installation space requirement.

Furthermore, it is advantageous if the free end of the actuating lever, which is arranged in the inner space of the insulating-material housing adjacent to the clamping site, comprises a protruding lug that forms in part the conductor inserting opening and guides an electrical conductor to the clamping site. Such a protruding lug forms a conductor inserting funnel and furthermore has the advantage in particular in conjunction with the optional depression for receiving a section of the clamping limb that it contributes to a sufficient reinforcement in the actuating region that acts on the clamping limb. The risk of the actuating lever bending is consequently reduced.

In order to improve the actuation of the actuating lever on the outer side for example by means of a screwdriver as the actuating tool, it is furthermore advantageous if the free end that is accessible from the outer side of the insulating-material housing comprises an actuating depression, for example in the form of a slot or cross slot. The free end of a screwdriver can be inserted into the slot and prevented by means of the actuating depression from slipping out.

It is preferred that the spring-force terminal connection comprises at least one current rail piece having a clamping section that provides together with a clamping edge of the clamping limb a clamping site for clamping an electrical conductor between the clamping edge and the clamping section. An electrical conductor that is inserted into an allocated conductor inserting opening is pushed by virtue of the force of the clamping spring against the clamping section of the current rail and is connected to the current rail in an electrically conductive manner at that site. The electrically conductive connection of the spring-force terminal connection to a circuit board or to any other electrical connection can be achieved if the current rail is connected in an electrically conductive manner to at least one connection contact, for example in the form of a soldering pin, a soldering lug or a plug contact. The soldering pin or the soldering lug protrudes out of the insulating-material housing.

A particularly compact spring-force terminal connection that has a simple construction and can be fixedly clamped to the electrical conductor can be achieved if the current rail piece for a clamping spring is in one piece and comprises a planar clamping section having a curved section for forming the clamping surface, a planar conductor guiding surface that bends away from the planar clamping section, and a contact surface that bends away from the conductor guiding surface. The contact limb of the U-shaped bent clamping spring lies at least in part against the contact surface. The free end of the clamping limb faces towards the curved section so as to clamp an electrical conductor between the free end of the clamping limb of the clamping spring and the curved section of the planar clamping section of the current rail piece.

The current rail piece forms in this manner a cage that is closed in the cross section at least in part by means of the clamping section, the conductor inserting surface and the contact surface and the U-shaped clamping spring is mounted in said cage. This spring-force terminal connection is self-supporting insofar as the clamping force that acts on the electrical conductor is captured by the current rail piece and not further transmitted to the insulating-material housing.

It is particularly advantageous if two resilient arms that extend adjacent to one another and comprise mutually facing curved sections for forming a plug contact protrude from the planar clamping section and the conductor guiding surface. It is thus possible for example for a circuit board having contact tracks arranged thereon to be positioned between these resilient arms or for the spring-force clamping connection to be plugged onto such a circuit board and connected in an electrically conductive manner to the contact surfaces on the circuit board. These resilient arms can for example protrude in the extension direction of the contact limb or in the conductor inserting direction and thus extend the spring-force terminal connection downwards. However, it is also feasible that the resilient arms are bent at an angle towards the contact limb or in the conductor inserting direction and the extension direction of the actuating lever and extend in an inclined manner with respect to the contact limb in an angle region of more than 0 degrees up to preferably approx. 45 degrees.

The invention is further explained hereinunder with reference to an exemplary embodiment and the attached. drawings, in which.

Figure 1:
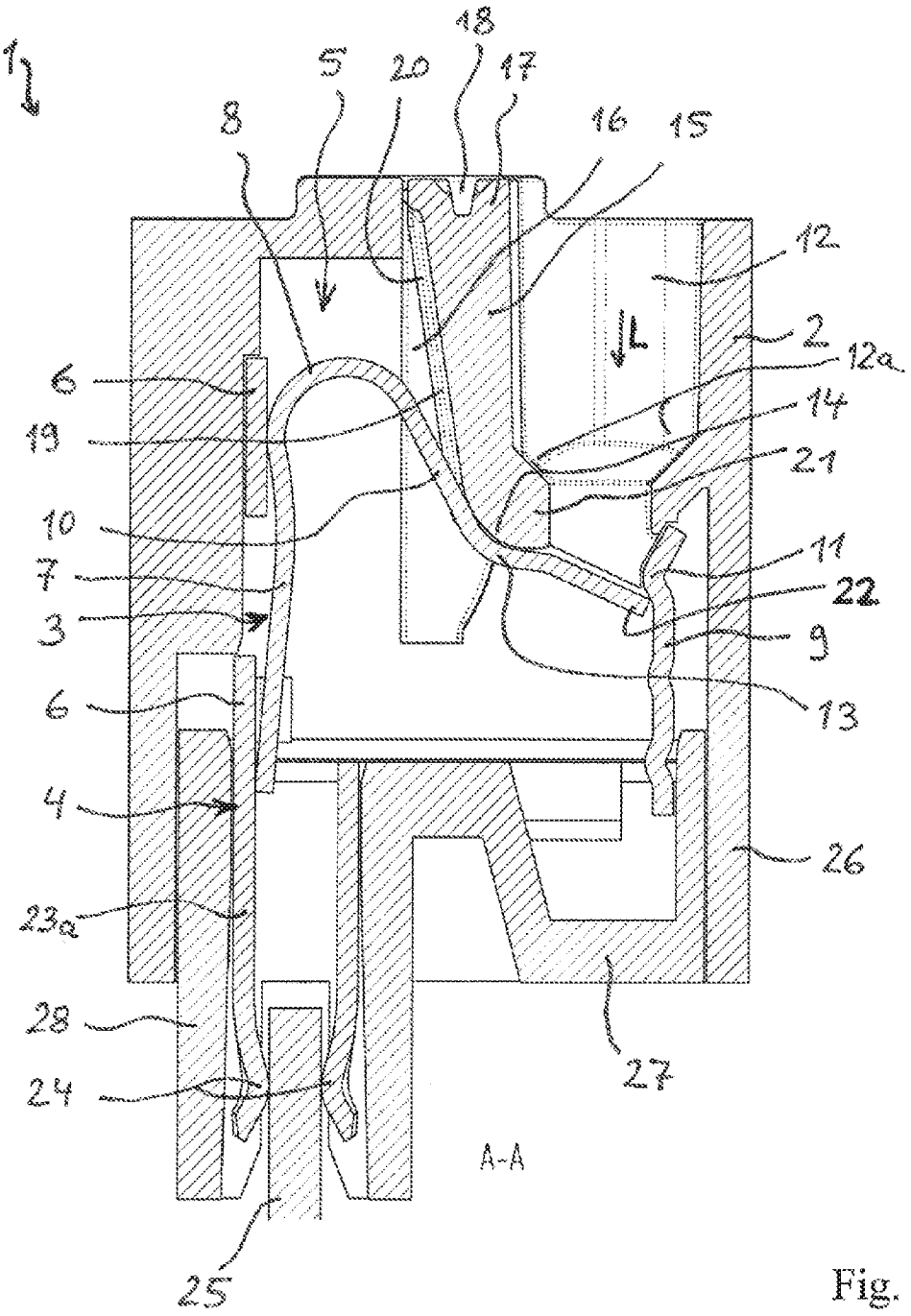
FIG. 1 illustrates a cross-sectional view through one embodiment of the spring-force terminal connection.

FIG. 1 illustrates a side sectional view of a spring-force terminal connection 1. The spring-force terminal connection 1 is embodied in the illustrated exemplary embodiment as a plug connector and comprises an insulating-material housing 2 in which it is possible to install a plurality of conductor connecting terminals 3 adjacent to one another. The conductor connecting terminals 3 comprise in each case a current rail piece 4 and also a clamping spring 5. The current rail piece 4 is embodied from a folded sheet metal element and comprises a contact surface 6 against which lies a contact limb 7 of the clamping spring 5 at least in part for example in the region of a spring bow 8 that adjoins the contact limb 7 and lies against the free end of the contact limb 7.

A planar conductor guiding surface is bent by 90° away from the contact surface 6 of the current rail piece 4 (not visible) and said planar conductor guiding surface extends to a clamping section 9 that lies opposite the contact surface 6. The clamping section 9 is bent away from the conductor guiding surface, which is not visible in the illustrated section, by 90° parallel to the contact surface 6.

The clamping spring 5 comprises adjacent to the spring bow 8 a clamping limb 10 that extends with its free end as far as the clamping section 9 of the current rail piece 4. The clamping section 9 comprises a curved section 11 for forming a defined clamping surface at which an electrical conductor [not illustrated] is clamped on by means of the free end of the clamping limb 10 during insertion into a conductor inserting opening 12 of the insulating-material housing 2. Consequently, the force of the clamping spring 5 concentrates on the curved section 11 with a reduced contact surface and ensures a reliable contact with sufficient surface pressure.

The clamping limb 10 comprises a bend 13 so as to form an actuating recess into which an actuating surface 14 of an actuating lever 15 engages. The actuating lever 15 is received in a displaceable manner in a lever opening 16 of the insulating-material housing 2. It is evident that the actuating lever 15 is accessible from outside at a head end 17 from the outer side of the insulating-material housing 2 so as to displace the actuating lever 15 in the conductor inserting direction L. The head end 17 comprises an actuating depression 18 for receiving the free end of a screwdriver in order to push the actuating lever 15 downwards with the aid of a screwdriver so as to open the clamping site. The actuating recess 18 can be embodied for example as a slot or cross slot.

It is clear that the actuating lever 15 tapers from the head end 17 to the actuating surface 14 in the inner space of the insulating-material housing 2. At least in the region of the actuating surface 14, the actuating lever 15 comprises on the rear side a depression 19 that is delimited sideward by means of two opposite edge connecting pieces 20. The clamping limb 10 engages in this recess 19, as a consequence of which the actuating lever 15 is guided in such a manner that it cannot tilt at the clamping limb 10. It is further clear that a lug 21 that protrudes in the direction towards the conductor inserting opening 12 is provided on the end of the actuating lever 15 that lies opposite the head end 17 and the actuating surface 14 is provided on the rear side of said lug 21. This lug 21 forms together with the adjacent insulating-material housing 2 a conductor inserting funnel 12*a* so as to guide an electrical conductor through the conductor inserting opening 12 towards the clamping site for the electrical conductor, said clamping site being formed by means of the curved section 11 and the clamping edge 22 that is embodied on the free end of the clamping limb 10.

It is evident that the actuating lever 15 not only forms a part of the wall of the conductor inserting opening 12 together with the adjacent insulating-material housing 2 in the region of the protruding lug 21 but it also forms a part of said wall in the region that lies above the region of the protruding lug 21 and is adjacent to the conductor inserting opening 12. This renders it possible to achieve a very compact design of the spring-force terminal connection 1.

A first resilient arm 23*a* protrudes from the contact surface 6 of the current rail piece 4 in the conductor inserting direction L or in the extension direction of the contact limb 7 of the clamping spring 5. A second resilient arm 23*b* extends parallel to the first resilient arm 23*a*. This resilient arm is embodied from the identical sheet metal material and is bent from the conductor guiding surface [not visible]. The two resilient arms 23*a*, 23*b* comprise in each case a curved section 24 and form together a plug contact so as to contact a contact surface [not visible] of a circuit board 25 that can be pushed between the resilient arms 23*a*, 23*b*. Consequently, it is possible to attach the spring-force terminal connection 1 to a circuit board 25, to connect to the contact tracks on the circuit board 25 in an electrically conductive manner and produce an electrically conductive connection to an electrical conductor that is clamped on.

It is further clear that the insulating-material housing 2 is embodied in two parts and comprises an upper part 26 and also a lower part 27. The upper part 26 receives the clamping spring 5 and the current rail piece 4 and also the actuating lever 15 and is sealed by the lower part 27. The lower part 27 and the upper part 26 are latched with one another preferably by means of latching elements. The lower part 27 comprises at least one protective sleeve 28 that surrounds the resilient arms 23*a*, 23*b* and comprises in the lower end an opening for inserting the circuit board 25.

Figure 2:
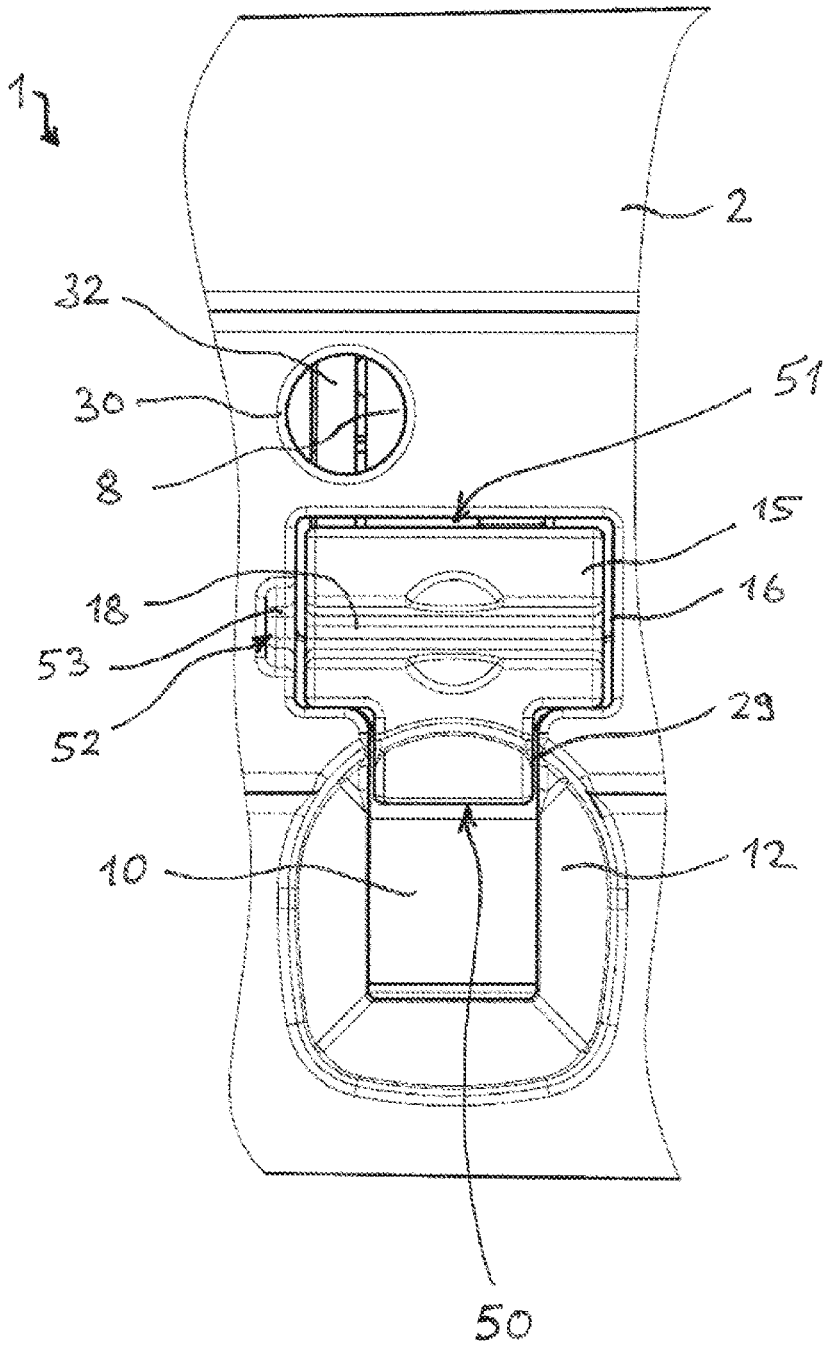
FIG. 2 illustrates a plan view of the spring-force terminal connection in a partial view.

FIG. 2 illustrates a plan view in a part view of the spring-force terminal connection 1. The figure illustrates only a single conductor connecting terminal. The spring-force terminal connection 1 can comprise multiple such conductor connecting terminals 3 adjacent to one another. It is evident from the plan view that the actuating lever 15 forms a part of the wall of the conductor inserting opening 12. The insulating-material housing 2 is open towards the lever opening 16, wherein the lever opening 16 is essentially broader than the duct 29 that leads to the conductor inserting opening 12. The lever opening 16 thus becomes wider starting from an outlet section 50, which is adjacent to the conductor inserting opening 12, and leading to the back 51 of the lever opening 16 that is opposite the conductor inserting opening 12. The cross section of the actuating lever 15 is tailored to suit the widening contour of the lever opening 16. The actuating lever 15 is guided in the insulating-material housing 2 in such a manner as to prevent tilting and rotating and nevertheless ensures a very compact construction.

It is further evident that the lever opening 16 becomes wider in the extension of the actuating depression 18 as a result of a bulge 52 in the insulating-material housing 12. As a result, the actuating lever 15 can also be actuated (pressed downwards) using conventional wider screwdrivers using the available installation space and maintaining the air paths and creeping distances. The bulge 52 comprises a base surface 53 with which a maximum actuating depth is predetermined. By virtue of the fact that a screwdriver makes contact with the base surface 53 at a maximum insertion depth, it is possible to effectively prevent an overload, of the actuating lever 15 and/or the clamping spring.

An inspection orifice 30 is provided in the insulating-material housing 2 and adjacent to the actuating lever opposite the conductor inserting opening 12, said inspection orifice leading to the spring bow 8 of the clamping spring 5. By virtue of inserting a test pin through the inspection orifice 30, it is possible to check as to whether an electrical potential is present at the conductor connecting terminal 1. The inspection orifice 30 leads preferably to the current rail piece 4 so that the testing pin comes into electrical contact with the current rail piece 4. In contrast to gripping the clamping spring 5, this has the advantage that the ohmic resistance of the current rail piece 4 is generally lower than the ohmic resistance of the clamping spring 5 and the voltage potential can thus be measured at the current rail piece 4 by way of the clamping spring 5 more precisely, in other words without having been influenced by a voltage drop.

Figure 3:
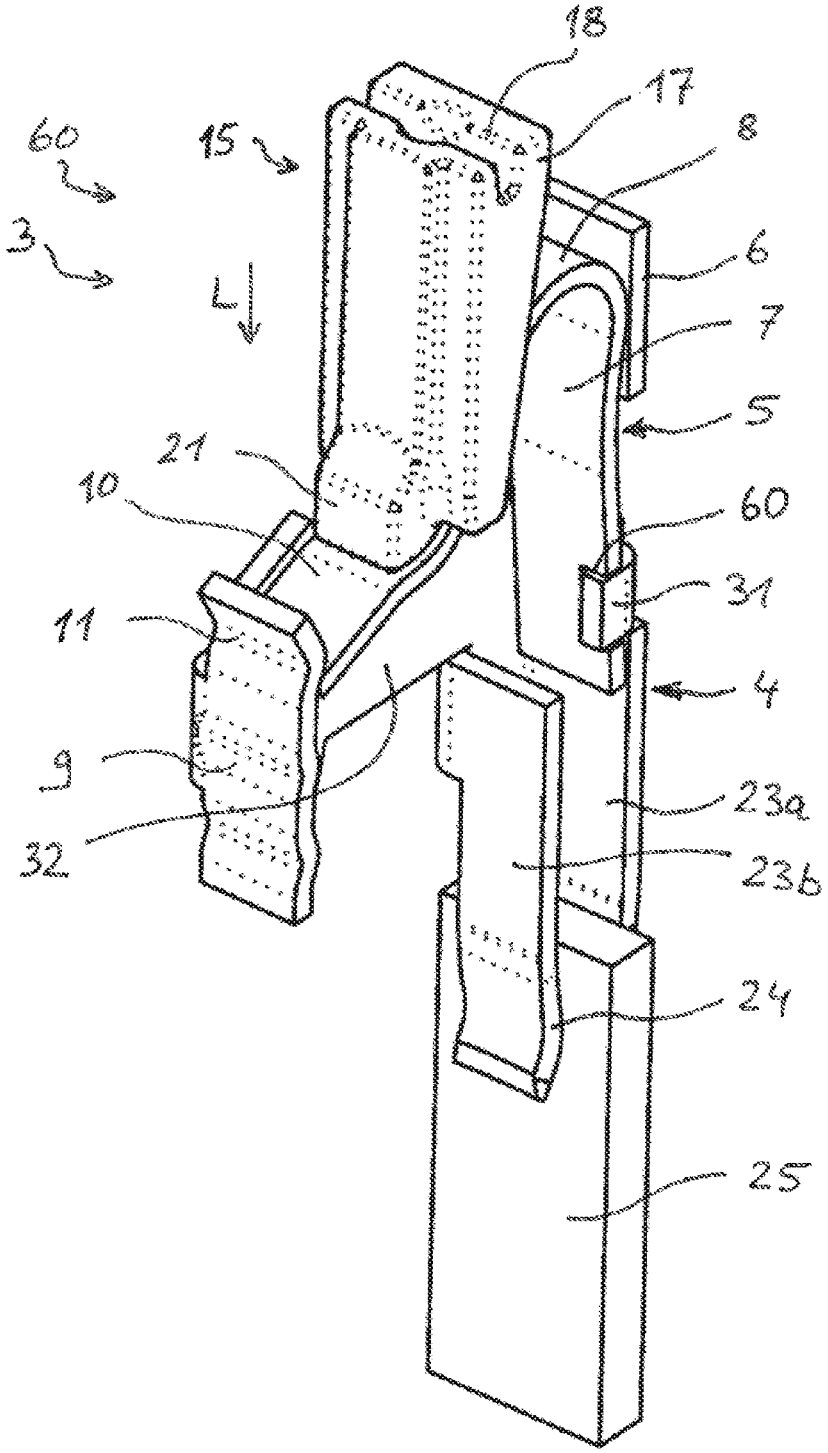
FIG. 3 illustrates a perspective view of the spring-force terminal connection in FIG. 1 without the insulating-material housing.

FIG. 3 illustrates a perspective view of a conductor connecting terminal 3 that is formed by means of the current rail piece 4, the clamping spring 5 and the actuating lever 15. It is clear that the contact limb 7 of the clamping spring 5 is fixed against the contact surface 6 with the aid of a material flap 31 that is bent out of the contact surface 6 of the current rail piece 4. It is preferred that this material flap 31 engages into a recess 60 of the contact limb 7 in order as a consequence to fix or rather secure at that site the contact limb 7 to the current rail piece 4 in the vertical direction.

Furthermore, it is clear that the clamping section 9 is bent away from a conductor inserting surface 32 that extends at a right angle thereto in the direction towards the contact surface 6 and is supported by said contact surface freely in the space.

It is further evident that the second resilient arm 23*b* is likewise freely stamped or freely cut out from the conductor inserting surface 32 and folded and extends parallel to the first resilient arm 23*a*.

Figure 4:
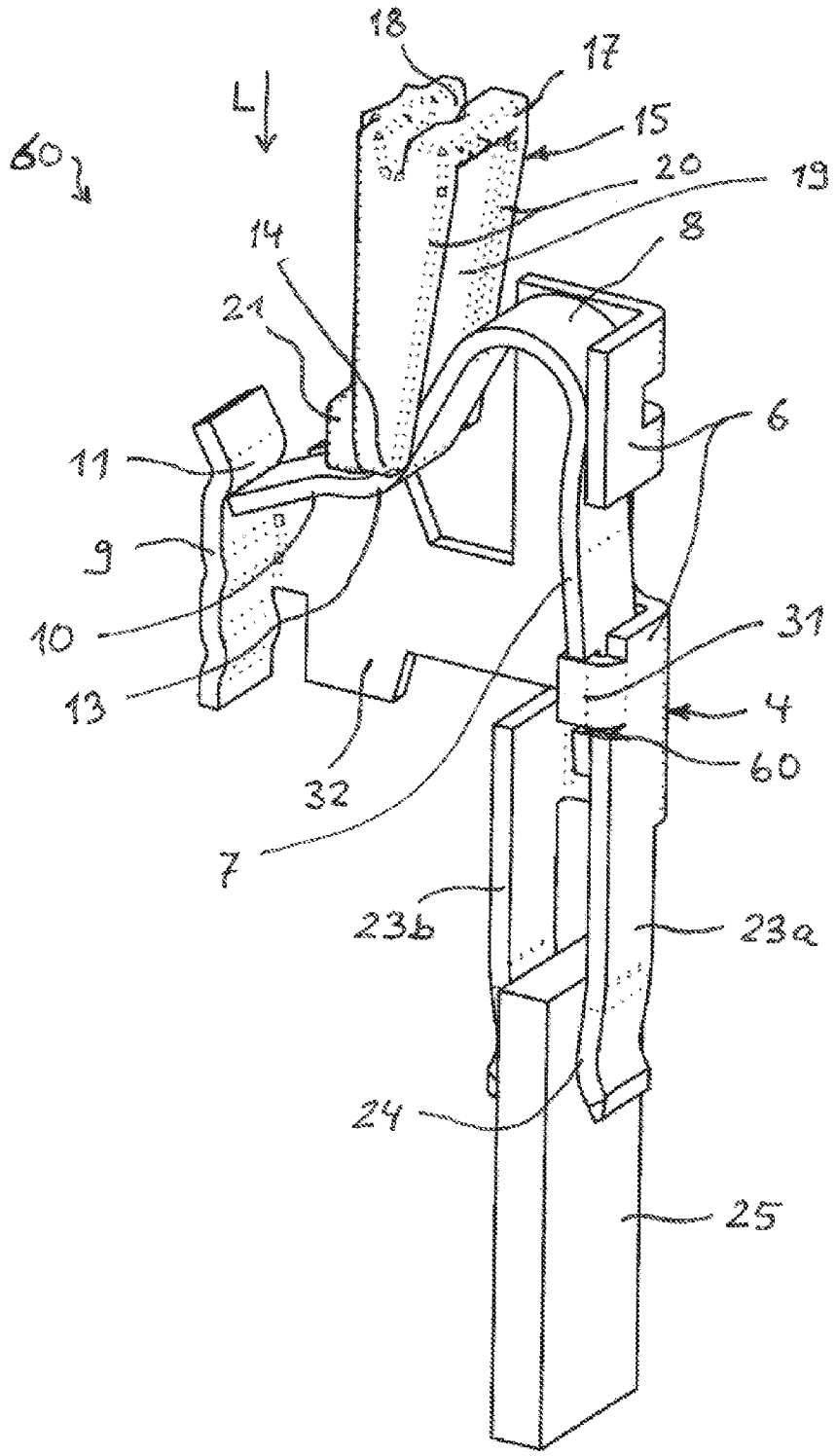
FIG. 4 illustrates a perspective side view of the spring-force terminal connection in FIG. 3 without the insulating-material housing.

FIG. 4 illustrates the conductor connecting terminal 3 in the perspective rear side view. It is again clear that the current rail piece 4 is a one-piece sheet metal part that comprises a planar conductor inserting surface 32 as a main surface. The clamping section 9 is bent at the front side at a right angle from the planar conductor inserting surface 32. This is further reshaped, by forming inter alia the curved section 11 but also by forming further curved sections. These further curved sections are used to increase the stability of the clamping section 9 and to increase the reliability of the contact.

Lying opposite to the clamping section 9, the contact surface 6 is bent, said contact surface being embodied from an upper folded section and a lower folded section. The material flap 31 is bent over at the lower folded section so as to fix the contact limb 7. Furthermore the first resilient arm 23*a* extends from the lower section of the contact surface 6 in the conductor inserting direction L downwards, in other words in the direction of the extension direction of the contact limb 7 of the clamping spring 5.

It is clear in this illustration that the actuating lever 15 comprises at the rear side a depression 19 that is delimited on both sides by connecting pieces 20 and the clamping limb 10 of the clamping spring 5 is received in part in said depression. As a result, the actuating lever 15 is guided at the clamping limb 10 in such a manner that it cannot tilt. It is also clear that the lug 21 extends at the actuating lever 15 in the direction towards the planar clamping section 9 of the current rail piece 5 and in particular in the direction of the curved section 11 of the clamping section 9.

Figure 5:
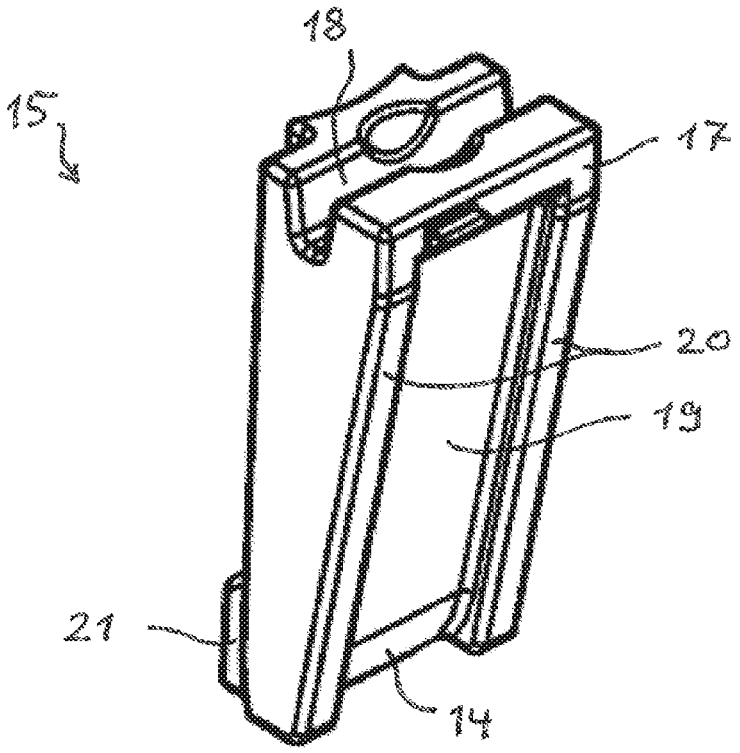
FIG. 5 illustrates a perspective rear side view of the actuating lever for the spring-force terminal connection in FIGS. 1 to 4.

FIG. 5 illustrates a perspective rear side view of the actuating lever 15. It is clear that the actuating lever 15 comprises at the rear side a depression 19 that extends from the head end 17 towards the lower free end with the actuating surface 14 and said depression is delimited at the sides by connecting pieces 20. The depression 19 extends in a convex curved manner in the direction towards the lower free end by forming an actuating surface 14 and leads to the lug 21.

Figure 6:
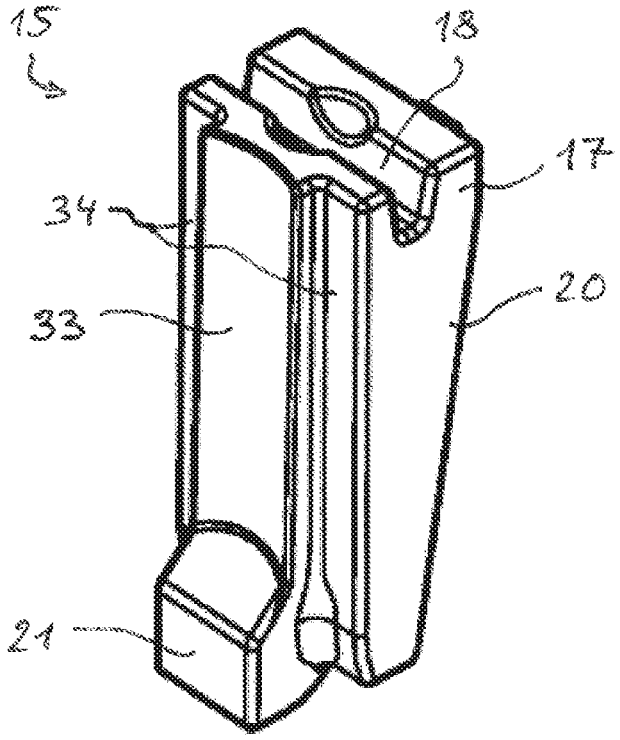
FIG. 6 illustrates a perspective front view of the actuating lever in FIG. 5.

FIG. 6 illustrates a perspective front face view of the actuating lever 15. It is clear that a conductor guiding surface 33 that is curved in a concave manner and protrudes opposite the main part 35 of the actuating lever 15 is provided lying opposite to the rear-side depression 19 having the connecting pieces 20 and said conductor guiding surface 33 extends from the head end 17 towards the free end as far as the lug 21. This concave conductor guiding surface 33 forms a part of the conductor inserting opening 12 and by forming two guiding recesses 34 that extend in the longitudinal direction of the actuating lever 15 comprises a narrower cross section than the main part of the actuating lever 15. This concave conductor guiding surface 33 is received in the narrow duct 29 of the insulating-material housing 2 and is adjacent to the lever opening 16 in the insulating-material housing 2.

The actuating lever 15 has thus a cross section that is almost T-shaped.

Furthermore, it is evident that the actuating lever 15 is embodied in such a manner that it extends in a conical manner, in other words tapers, from the head end 17 toward the lower free end having the lug 21.

Figure 7:
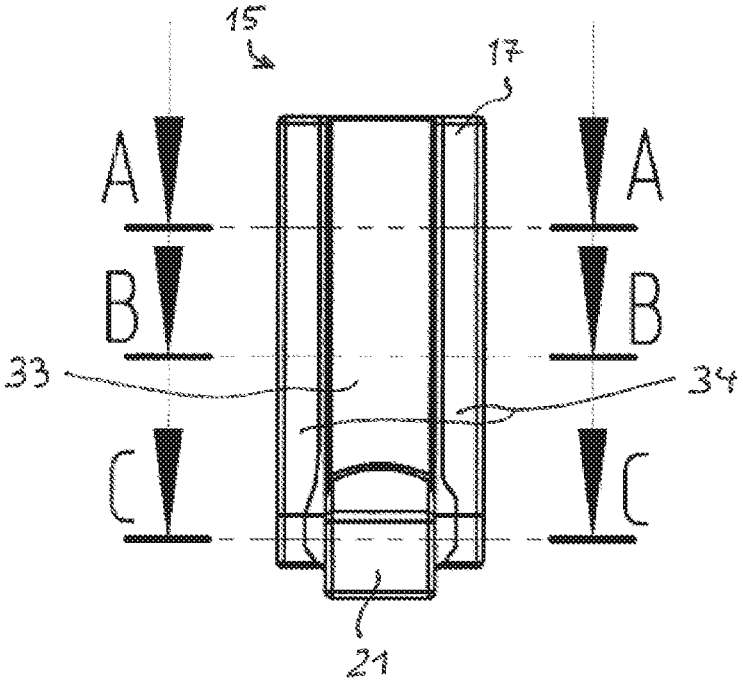
FIG. 7 illustrates a front view of the actuating lever with the section lines A-A, B-B and C-C.
Figure 8:
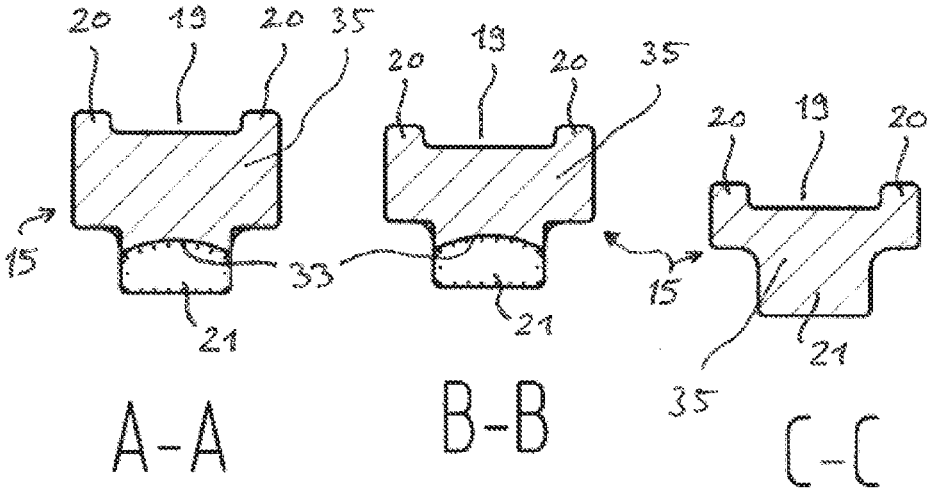
FIG. 8 illustrates in the part figures a) to c) the actuating lever in the section line A-A, B-B and C-C.

FIG. 7 illustrates a front view of the actuating lever 15 with the section lines A-A in the upper region, B-B in the middle region and C-C in the lower region of the lug 21. The section line A-A is illustrated in the part figure a) of FIG. 8. The part figure b) illustrates the section line B-B and the part figure c) illustrates the section line C-C.

It is clear that the thickness of the material of the actuating lever 15 reduces as a result of the conically extending (tapering) shape of the actuating lever 15 from the head end 17 to the free actuating end, in other words from the section line A-A to the section line C-C. It is also clear that the actuating lever 15 has a cross section of an almost T-shape with a widened main part 35 and a concave conductor inserting surface 33 that protrudes centrally therefrom.

Figure 9:
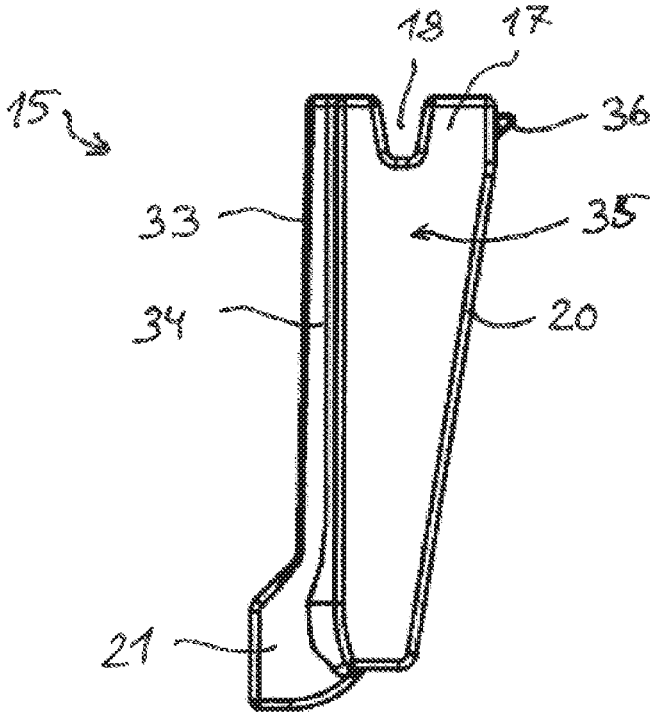
FIG. 9 illustrates a side view of the actuating lever in FIGS. 5 to 8.

FIG. 9 illustrates a side view of the actuating lever 15. Again, the tapering contour of the actuating lever that extends from the head end 17 to the free actuating end having the lug 21 is clear here. It is also clear that the concave conductor guiding surface 33 that leads to the lug 21 is embodied narrower than the main part 35 by forming guiding recesses 34 on the sides.

Figure 10:
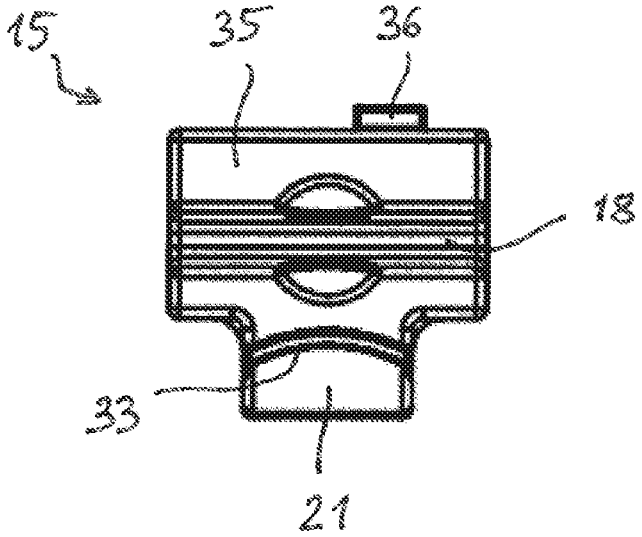
FIG. 10 illustrates a plan view of the actuating lever in FIGS. 5-9.

FIG. 10 illustrates a plan view of the actuating lever 15. Again, the T-shaped cross section is clear. It is also evident that a latching lug 36 is formed in an integral manner lying opposite the concave conductor guiding surface 33 and the lug 21 and said latching lug 36 cooperates with a corresponding stop or a corresponding latching opening in the conductor inserting opening 2 in the region of the lever opening 16 and prevents the actuating lever 15 from falling out of the insulating-material housing 2.

Figure 11:
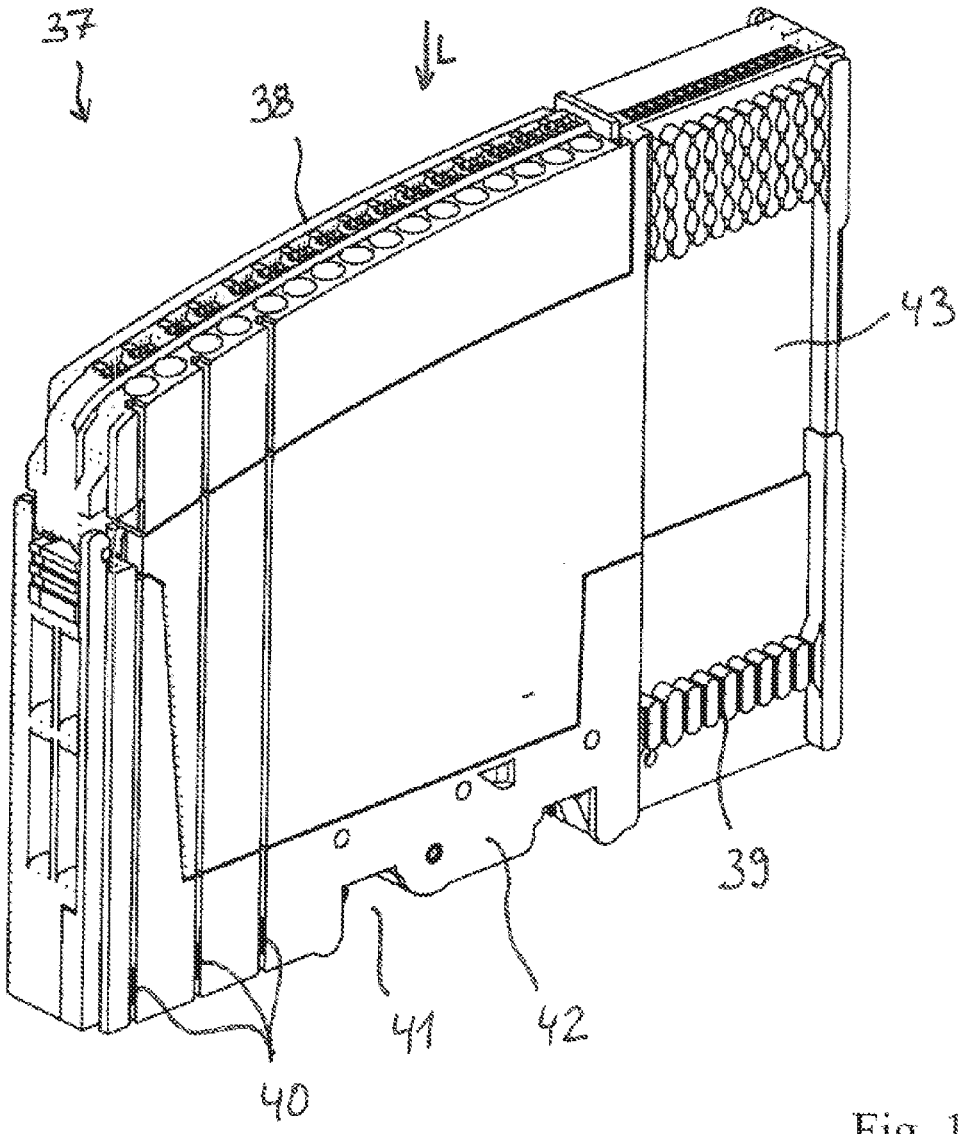
FIG. 11 illustrates a perspective view of an electronic device with a plug connector.

FIG. 11 illustrates a perspective view of a modular electronic device 37 as is used in particular for a modular control unit. The electronic device 37 is for example an input or output module to which bus components (sensors, actuators or other devices) can be connected at a plug connector 38. These bus components can then communicate with a control unit (not illustrated) that is connected by way of a data bus to the electronic device 37. The data bus is established by way of plug contacts 39 on the mutually opposite side walls of the electronic device 37. A power supply can likewise be provided on the opposite-lying side walls when plugging a sequence of such electronic devices 37 one next to the other onto a carrier rail by may of plug contacts 40. The electronic device 37 has a latching foot 41 on a base module 42 which can be used to latch the base module 42 to a carrier rail (not illustrated).

It is possible to plug onto the base module 42 an electronic device 43 that has an electronic system that is tailored to suit the functionality of the electronic device 37 and is on a circuit board that is provided in the electronic module 43. The plug connector 38 that forms an above-described spring-force terminal connection can be plugged onto this electronic module 43.

Figure 12:
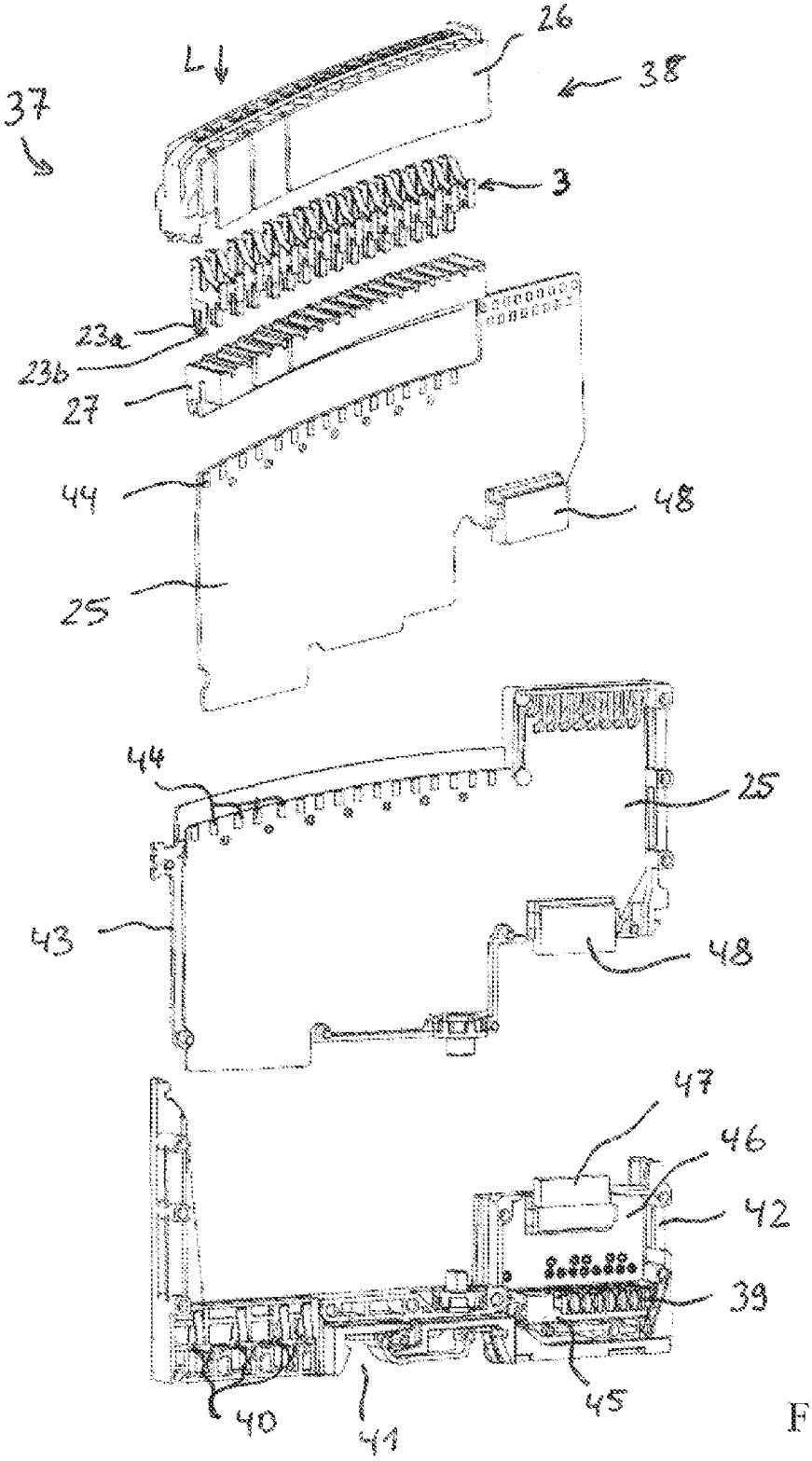
FIG. 12 illustrates an exploded view of the electronic device in FIG. 11.

FIG. 12 illustrates an exploded view of the electronic device 37 in FIG. 11. It is clear that the plug connector 38 is formed as illustrated in FIG. 1 from a plug connector upper part 26 and a plug connector lower part 27 embodied from an insulating material. A number of conductor connecting terminals 3 are received in the plug connector upper part 26 and plug connector lower part 27 spaced apart and electrically insulated from one another by means of insulating-material walls. It is clear that the resilient arms 23*a*, 23*b* protrude in the direction towards the circuit board 25 so as in the positioned state to make electrically conductive contact with circuit tracks 44 and/or contact sites on the circuit board 25.

It is further evident that the base module 42 comprises a plug contact insert 45 that has plug contacts 39 that are accessible from the side. This plug contact insert 45 is connected to a circuit board 46 that is oriented parallel to the alignment of the circuit board 25 in the conductor inserting direction L. This circuit board 46 supports a plug connector 47 that is provided so as to make contact with a corresponding mating plug connector 48 on the circuit board 25 if the electronic module 43 is plugged onto the base module 42.

It is consequently possible to produce a signal connection between the bus component, which is connected to the plug connector 38, by way of an electronic system on the circuit board 25 and likewise on the circuit board 46 by way of the data bus that is established by means of the plug connectors 39 to a control unit that is directly or indirectly connected to the data bus 39.

The invention claimed is:

1. A spring-force terminal connection for clamping electrical conductors having:

an insulating-material housing that comprises at least one conductor inserting opening for inserting an electrical conductor, at least one clamping spring that comprises a contact limb, a clamping limb and a spring bow that connects the contact limb and the clamping limb to one another, and having at least one actuating lever that is received in a displaceable manner in the insulating-material housing and comprises an actuating surface for contacting the clamping limb and for displacing the clamping limb in the direction towards the contact limb so as to open the clamping site as the actuating lever is displaced in the direction towards the inner space of the insulating-material housing, characterized in that the at least one lever opening in the insulating-material housing for receiving an allocated actuating lever is open towards an allocated conductor inserting opening and that the actuating lever that is mounted in a displaceable manner in this lever opening forms part of the wall of the conductor inserting opening, wherein the lever opening becomes wider starting from an outlet section, which is adjacent to the conductor inserting opening, and leading to the back of the lever opening that is opposite the conductor inserting opening and wherein the cross section of the actuating lever is tailored to suit the widening contour of the lever opening.

2. The spring-force terminal connection as claimed in claim 1, characterized in that the actuating lever comprises, on the actuating surface that lies opposite the surface that forms a part of the wall of the insulating-material housing, a depression for receiving a section of the clamping limb.

3. The spring-force terminal connection as claimed in claim 1, characterized in that the actuating lever tapers from its head end, which is accessible from the outer side so as to displace the actuating lever, as far as the actuating surface that lies against the clamping limb in the inner space of the insulating-material housing.

4. The spring-force terminal connection as claimed in claim 1, characterized in that the free end of the actuating lever, which is arranged in the inner space of the insulating-material housing adjacent to the clamping site, comprises a protruding lug that forms in part the conductor inserting opening and guides an electrical conductor to the clamping site.

5. The spring-force terminal connection as claimed in claim 1, characterized in that the free end of the actuating lever that is accessible from the outer side of the insulating-material housing comprises an actuating depression.

6. The spring-force terminal connection as claimed claim 1, characterized in that the spring-force terminal connection comprises at least one current rail piece having a clamping section that provides together with a clamping edge of the clamping limb a clamping site for clamping an electrical conductor between the clamping edge and the clamping section.

7. The spring-force terminal connection as claimed in claim 6, characterized in that the current rail piece for a clamping spring is in one piece and comprises a clamping surface having a curved section for forming the clamping section, a planar conductor guiding surface that bends away from the clamping surface, and a contact surface that bends away from the conductor guiding surface, wherein the contact limb of the U-shaped bent clamping spring lies at least in part against the contact surface, and the free end of the clamping limb faces towards the curved section.

8. The spring-force terminal connection as claimed in claim 7, characterized in that two resilient arms that extend adjacent to one another and comprise mutually facing curved sections for forming a plug contact protrude from the clamping surface and the conductor guiding surface.

9. The spring-force terminal connection as claimed in claim 6, characterized in that the current rail piece is connected in an electrically conductive manner to at least one connection contact, wherein the connection contact is embodied as a soldering pin, soldering lug or as a plug contact.

10. The spring-force terminal connection as claimed in claim 1, characterized in that the insulating-material housing has a contact pin receiving opening that is oriented relative to the conductor inserting opening and the clamping spring in such a manner that an electrical conductor that is inserted into the conductor inserting opening and is acted upon by means of the clamping spring with a clamping force is contacted in an electrically conductive manner by a contact pin that is inserted into the contact pin receiving orifice.

11. A plug connector having an insulating-material housing and having at least one spring-force terminal connection as claimed in any one of the preceding claims, characterized in that the clamping spring is received in a plug connector lower part, and the actuating lever and the at least one conductor inserting opening are received in a plug connector upper part, wherein the plug connector upper part and the plug connector lower part have latching elements for mutually latching with one another.

* * * * *